United States Patent [19]

Bechtiger et al.

[11] 4,359,883

[45] Nov. 23, 1982

[54] TIME DELAY COMBINATION LOCK

[75] Inventors: Charles G. Bechtiger, La Chaux-de-Fonds, Switzerland; James C. Miller, Nicholasville, Ky.

[73] Assignee: Sargent & Greenleaf, Inc., Nicholasville, Ky.

[21] Appl. No.: 209,480

[22] Filed: Nov. 24, 1980

[51] Int. Cl.[3] ..... E05B 43/00

[52] U.S. Cl. ..... 70/269; 70/303 A

[58] Field of Search ..... 70/267, 268, 269, 272, 70/303 A

[56] References Cited

U.S. PATENT DOCUMENTS

| | | | |
|---|---|---|---|
| 2,029,272 | 1/1936 | Miller | 70/268 |
| 2,035,526 | 3/1936 | Brown | 70/269 |
| 2,079,702 | 5/1937 | Diesel | 70/269 |
| 2,097,035 | 10/1937 | Miller | 70/269 |
| 4,163,376 | 8/1979 | Miller | 70/303 A |

*Primary Examiner*—Robert L. Wolfe

*Attorney, Agent, or Firm*—Mason, Fenwick & Lawrence

[57] ABSTRACT

A time delay combination lock having the usual combination mechanism including a stack of rotatable tumbler wheels journaled on a dial spindle by a driving cam, and a fence lever pivoted on a bolt to descend to a lower coupled position with the drive cam and retract the bolt along an unlocking path when the proper combination is dialed. A timing movement is provided having an intercoupling gear train including an input gear rearwardly adjacent the driving cam for winding the main spring to woundup condition upon rotation of the dial and driving cam through a predetermined arc. A pivoted blocking lever biased to a normal stop position is located in the unlocking path of part of the fence lever to bar unlocking movement of the fence lever in its lower coupled position, and the lock case has a fixed backup shoulder immediately adjacent the blocking lever to support the blocking lever against attempted forced displacement of the fence lever and bolt in a bolt unlocking direction. The intercoupling gear train permits multidirectional operation of the dial to dial the combination for a limited time dialing period following wind-up of the main spring, and a lever system is provided to displace the blocking lever to a release position for a later short time period after termination of the multidirectional dialing period to allow retraction of the bolt to unlocked condition. A formation on the input gear bars change key access to the combination change mechanism except at selected positions.

22 Claims, 9 Drawing Figures

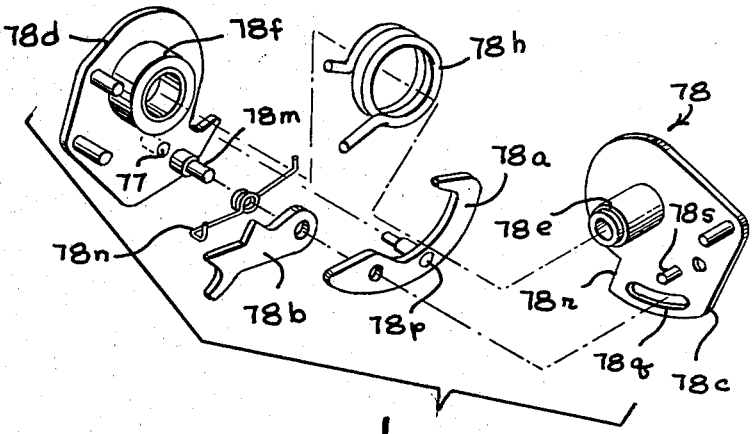
Fig-7
Fig-9
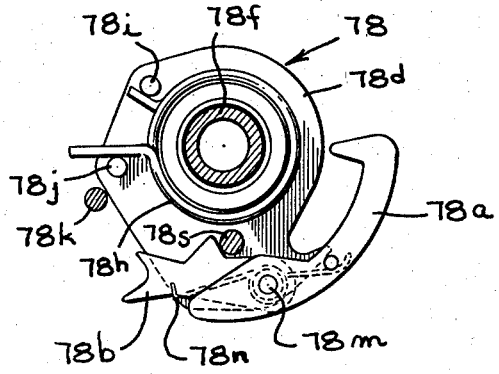
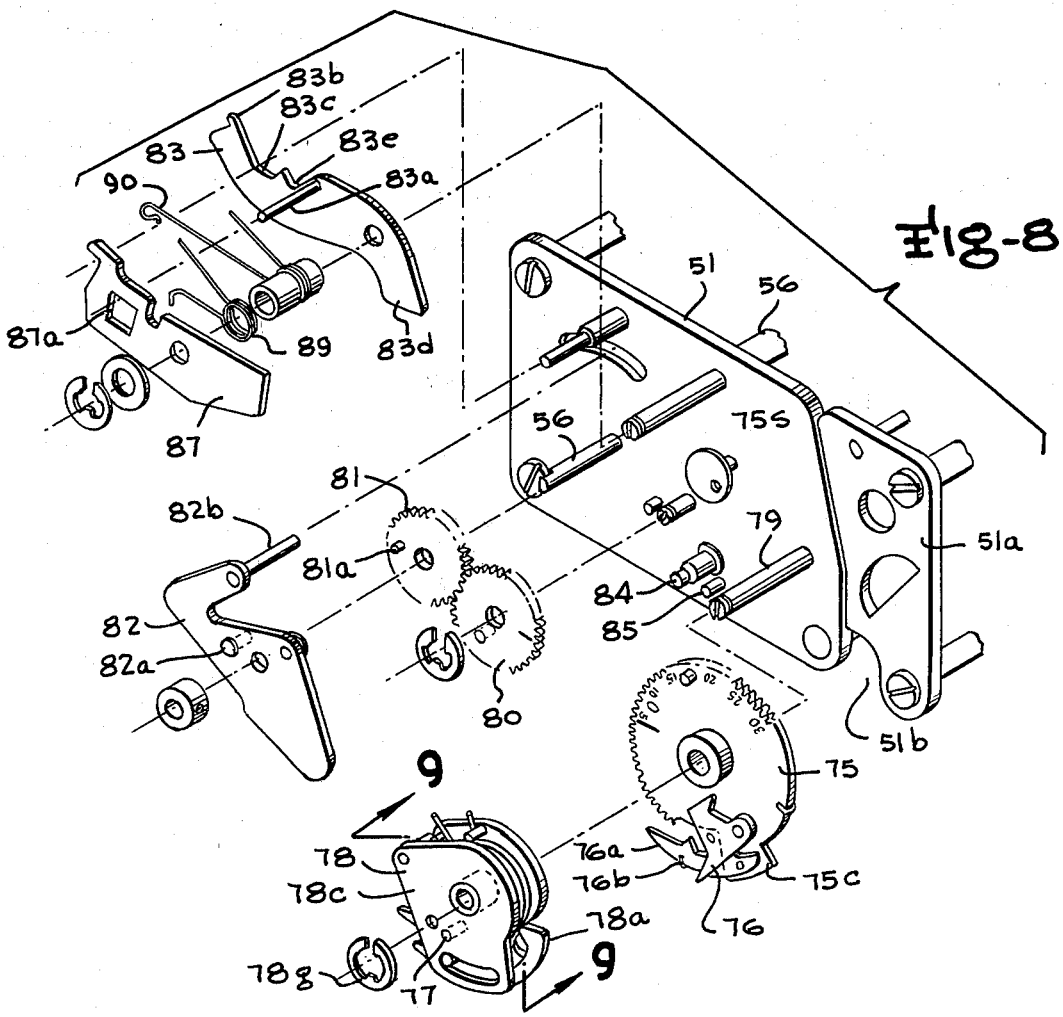
Fig-8

TIME DELAY COMBINATION LOCK

BACKGROUND AND OBJECTS OF THE INVENTION

The present invention relates in general to combination locks, and more particularly to time delay combination locks of the tumbler wheel type having a timing mechanism therein interrelated with the tumbler wheel and drive cam pack to effect retraction of the bolt a selected time delay period following adjustment of the tumblers in accordance with the proper dial combination.

The present invention is directed to an improved time lock for protecting safes, vaults and other enclosures which incorporate a plurality of tumblers, a driving cam spindle connected to a dial, and associated components typical of tumbler wheel type combination locks, together with a timing mechanism and interconnections for delaying the time at which the safe door can be opened after successful operation of the combination, thereby discouraging daylight holdups. Heretofore, a number of such time delay combination lock mechanisms have been produced, many of which were of the type disclosed in earlier U.S. Pat. Nos. 1,867,001 and 2,079,702 to Diesel and 2,035,526 to Brown, all assigned to the assignee of the present invention. Each of these involves a plurality of tumbler wheels, a driving cam and spindle connection from the driving cam to an operating dial, and lost-motion driving connections, together with a timing mechanism which was provided with means for preventing the usual fence lever pivoted to the bolt from dropping to the unlocking position for retraction of the bolt until a preset time delay period following dialing of the proper combination.

More recently, similar time delay combination locks have been produced commercially, involving one timer unit, or a pair of tandem operating timer units together with a blocking lever in the opening path of the fence lever which is under such control of the timer unit that the blocking lever is positioned to prevent retraction of the bolt until the time delay period has timed out. These prior time delay locks usually required complete removal of the timing mechanism from the lock casing in order to effect a change in the combination of the lock. Additionally, such locks encountered problems when forced entry was attempted because the timing movement was the source of the restraining force tending to hold the blocking lever against being forced to unlocking position and therefore the timing movement had to suffer the abuse of the forced entry attempt.

An object of the present invention is the provision of a novel time delay lock of the tumbler wheel combination lock type, wherein the mechanism is arranged in such a manner that the change key can be introduced into the lock case through the timing mechanism or timing movement to change the combination, without requiring removal of the timing mechanism from the lock case to effect combination change.

Another object of the present invention is the provision of a novel time delay combination lock of the plural tumbler wheel type, wherein the timer controlled blocking lever for restraining the lock against opening following dialing of the proper combination until the delay period has timed out is in supported abutment with integral shoulder formations on the lock case or housing, facilitating resistance to forced entry attack on the lock by providing lock casing support against forced dislodgment of the blocking lever.

Other objects, advantages and capabilities of the present invention will become apparent from the following detailed description, taken in conjunction with the accompanying drawings illustrating a preferred embodiment of the invention.

BRIEF DESCRIPTION OF THE FIGURES

FIG. 7 is an exploded perspective view of the input package;

FIG. 8 is an exploded perspective view of the delay unit wheels and levers located forwardly of the time movement front plate; and FIG. 9 is a fragmentary section view, taken along the line 9—9 of FIG. 8 of the input package winding mechanism.

DETAILED DESCRIPTION OF A PREFERRED EMBODIMENT

Figure 1:
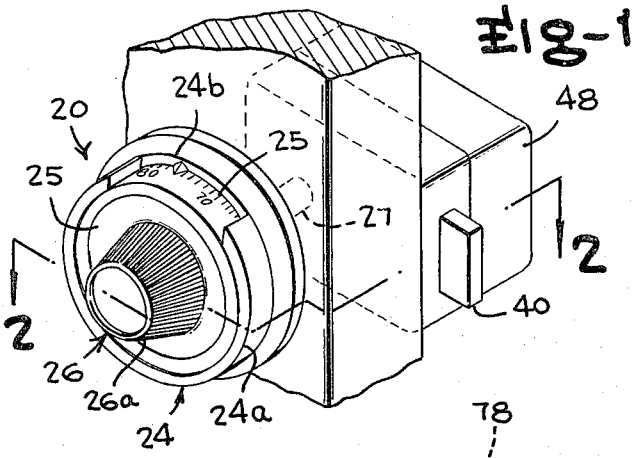
FIG. 1 is a front perspective view of a time delay combination lock assembly embodying the present invention.

Referring to the drawings, wherein like reference characters designate corresponding parts throughout the several figures, there is illustrated a time delay combination lock, indicated generally by the reference character 16, made-up of two subsections, a rearmost time delay mechanism section 18, and a tumbler wheel type combination lock section 20. The combination lock section generally indicated at 20 in general corresponds to the combination lock structure disclosed in earlier U.S. Pat. Nos. 2,275,674 and 2,807,954, issued to Harry C. Miller, or 4,163,376 to Benson L. Miller et al, assigned to Sargent & Greenleaf, Inc., except for modification of the driving cam structure to coact with the time delay section components. The combination lock section comprises a substantially rectangular lock case 21 having top and bottom walls **21*a*,21*b* and a hollow boss or tumbler post 22 projecting rearwardly from the front wall 23 thereof. The lock case is designed to be mounted against the inner surface of a safe or vault door or other closure in the conventional manner, as by mounting screws extending through screw holes near the corners of the lock case and into the supporting door structure. Secured to the outer face of the supporting door concentric with the axis of the tumbler post 22 is a dial ring 24, here shown as having a cylindrical shield 24*a* surrounding and shielding from view the major portions of the peripheral flange 25*a* of the dial portion 25 of the integral dial and knob member 26, the shield 24*a* being interrupted by a sight opening 24*b*** of suitable circumferential extent.

The dial and knob member 26 is supported for rotation within the forwardly opening cylindrical well of the dial ring 24 defined by the shield 24*a*, and includes a drive spindle 27 coupled at its outermost end to the dial and knob member 26 and extending through the hollow tubular post 22 on the front wall of the lock case 21 to be rotatably journaled by the tumbler post and supported at the desired position. The dial and knob member 26 has an integral knob portion 26*a* thereon which projects forwardly from the dial portion 25 and preferably has knurled periphery to facilitate manipulation of the dial and knob member 26.

The threaded rearmost end of the drive spindle 27 receives an internally threaded portion of a tubular boss formation 32*a* projecting forwardly integrally from the driving cam 32. The driving cam 32 is keyed to the drive spindle 27 at the desired angular position by inserting a suitable spline key into a radial groove in the center bore of the drive cam which is aligned radially with the longitudinal spline and with the kerf and the spindle 27 to interlock these components against further relative rotation.

The stack or array of plural tumbler wheels, for example the three wheel pack indicated by the reference characters 35,36 and 37, are supported to rotate freely on the portion of the hollow boss or tumbler post 22 projecting rearwardly from the front wall of the lock case 21. It will be appreciated, of course, that a four wheel stack, or a stack of any other number of tumbler wheels, may be used. Each of the tumbler wheels 35,36 and 37 is of the conventional type designed to be changed by means of a conventional resetting key to vary the combination of the lock. To this end, each tumbler wheel comprises an inner hub on which is supported a pair of annular discs having a tumbler gate or peripheral recess, such as the recess 35*a*, therein. The outer annular discs are selectively locked against rotation relative to their supporting hub by means of conventional locking arms or levers carried by and between the pair of annular discs on each hub and engaging peripheral serrations or teeth on the hub to hold the annular discs at a selected angular position, all as shown in earlier U.S. Pat. No. 1,484,692 to Weber.

Conventional flies 38, consisting of annular rings having an outwardly extending radial projection thereon are provided between the successive pairs of tumblers 37–36 and 36–35, and between tumbler 35 and drive cam 32, and an annular spacer washer 39, for example having an inner diameter conforming to the outer diameter of the tumbler post 22 and having a pair of outwardly projecting lugs extending into grooves on the post to prevent its rotation, is provided between each tumbler wheel pair. In the illustrated embodiment, the ring portion 38*a* of each fly 38 may be disposed in a rearwardly facing annular groove and the adjacent tumbler wheel hub portion, journaled on the cylindrical surface defining the radially innermost wall of the groove, with the radial projection 38*b* of the fly also lying in the groove and being of sufficient thickness to project radially into the path of the forwardly projecting drive pin 32*b* on the drive cam. The outermost cylindrical wall of this groove in the adjacent tumbler wheel hub portion is interrupted by a radially outwardly extending cut providing a well of about 20° circumferentially defining stop shoulders flanking the space occupied by the radial lug of the fly in the path of the radial lug to limit rotation of the fly to about 20°, as is well known in present day combination lock tumbler wheel construction. This provides the lost-motion coupling between the drive cam 32 and the rearmost tumbler 35. The flies associated with the other tumbler wheels 36 and 37 are similarly constructed and disposed in rearwardly facing grooves in those tumblers to provide lost-motion couplings coacting with forwardly projecting drive lugs on the tumbler wheels 35 and 36.

The combination lock section 20 is also provided with a bolt 40 which is adapted to slide in a suitable guideway formed in one end wall of the lock case 22. The bolt 40 is moved rectilinearly to retract it from the usual keeper recess and the confronting door jamb and to project it back into the keeper recess to assume locked position, by means of a fence lever 41 which is pivotally attached to the bolt by screw 42. The fence lever 41 is normally resiliently urged to the elevated or raised position illustrated in FIG. 3, by a lever spring, and is provided with a laterally projecting bar 44, commonly referred to as a fence, which projects along an axis parallel to the axis of the drive spindle 27 and overlies the peripheries of all of the tumbler wheels 35,36 and 37. The fence 44 is adapted to be received in the peripheral gates of the tumbler wheels, such as the gate 35*a* of wheel 35, when the tumbler gates are disposed in registry with each other at a chosen angular position upon operation of the dial and knob member 26 to the proper opening combination for the lock. When the dial and knob member 26 is rotated in a predetermined manner to bring zero mark on the dial to a lock opening position, the fence lever gate or peripheral recess 32*b* is then aligned below the nose of the fence lever to receive the fence lever at such time as it is allowed to drop by the time delay mechanism when the preset time delay period has been timed out, as later described. When the fence lever nose formation 41*a* is allowed to drop into the drive cam gate 32*c*, concurrently with the fence 44 dropping into the tumbler wheel gates aligned therewith, and the dial and knob member is rotated in the proper direction, the shoulder of the driving cam gate 32*c* engaging a complimentary shoulder on the fence lever nose causes the fence lever to be shifted in a manner to retract the bolt 40.

Figure 2:
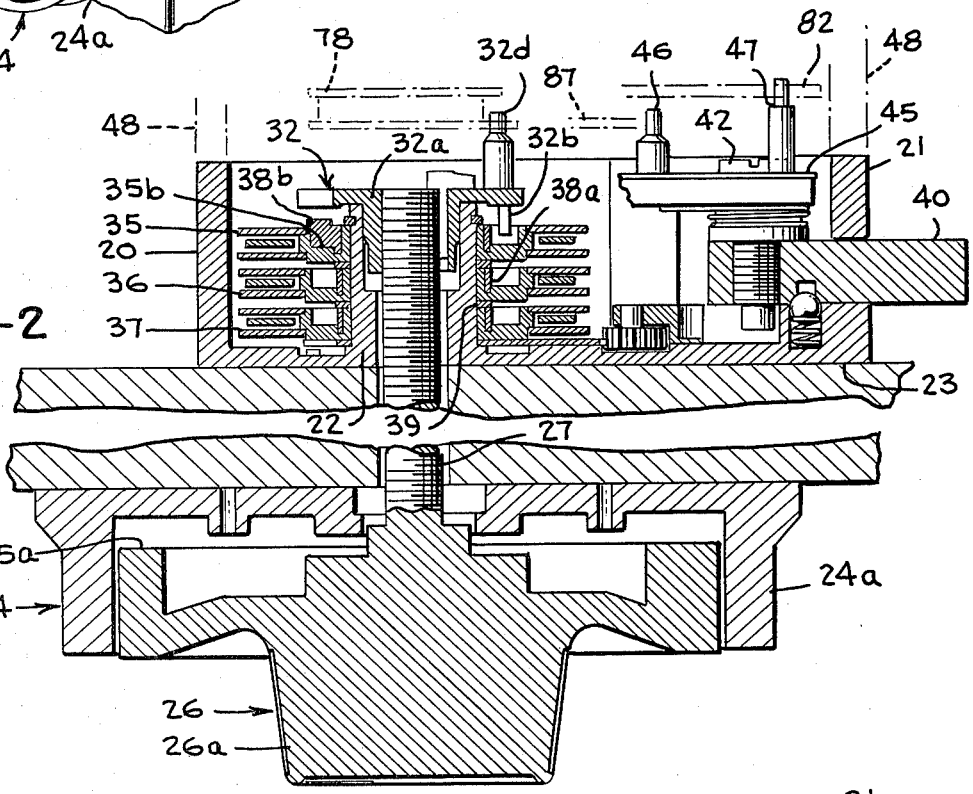
FIG. 2 is a horizontal section view through the combination lock section of the lock assembly with the time delay section removed, taken along the line 2—2 of FIG. 1 showing immediately adjacent elements of the time delay resting in phantom lines.
Figure 3:
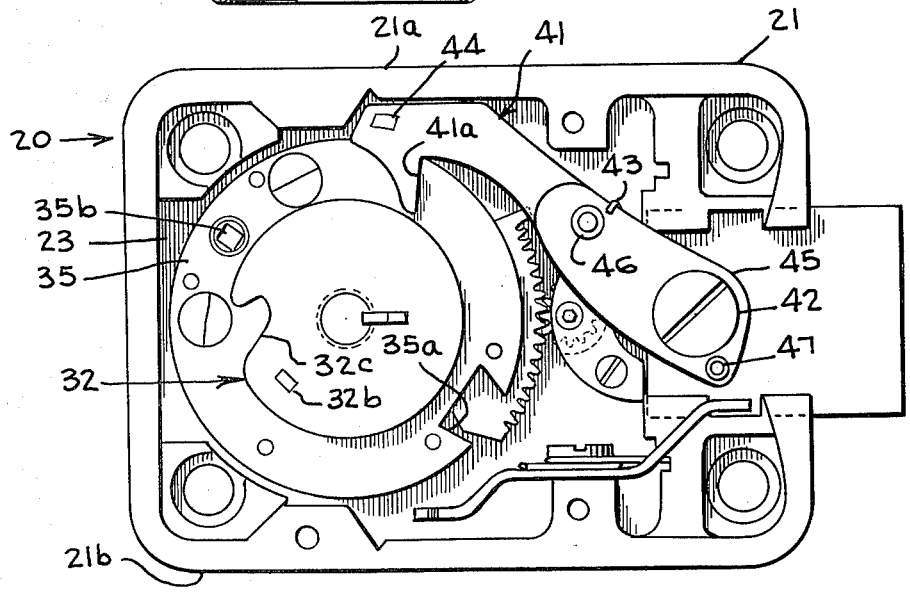
FIG. 3 is a rear elevation view of the combination lock section with the time delay section removed.

As shown in FIGS. 2 and 3, the drive cam 32 has a rearwardly projecting pin 32*d* extending rearwardly therefrom an appropriate distance to interfit into an input package or coupler mechanism, later described, of the time delay mechanism section 18, and the fence lever 41 includes an adapter plate member 45 fixed thereon, for example surrounding the screw 42 and extending upwardly alongside the adjacent lower arm portions of the fence lever 41, having a pair of rearwardly extending pins or studs 46,47 thereon to coact with a blocking lever and cam follower and interact levers of the time delay mechanism.

The time delay mechanism, as best illustrated in FIGS. 4 through 9 is housed in a rear case section 48 in the form of a forwardly opening case having a closed rear wall 48*a* and shaped to correspond in vertical cross-section to the shape of the top, bottom and end walls of the front lock case 21 to be assembled therewith by a pair of mounting screws extending through the screw holes near the corners of the lock case 21 and into the door or other supporting wall.

The rear case section 48 has rigidly mounted therein one or a pair of timer units or time movements, generally indicated at 49, which has a clockwork mechanism generally similar to the timer units typically used in time locks employed in time vault locks and the like. While a preferred embodiment uses a pair of such timer units stacked in tandem one in front of the other within the rear case section 48, only a single such timer unit may be used and only one timer unit is specifically described. Each such timer unit or time movement 49 includes a clock gear train and escapement mechanism, generally indicated at 50, carried by a supporting frame of generally conventional construction, for example formed of a pair of spaced parallel front and back plates 51,52, separated and fixed in essentially parallel spaced relation to each other by spacer posts 53 and screws 54 at the corners of the plates. If an array of two such timer units is provided, three plates would be used, similarly spaced and supported by spacer posts and screws. In the illustrated embodiment, the front plate 51 is subdivided to provide a generally triangular plate section, indicated at 51*a*, forming the top escapement plate for supporting the escapement and balance components (the front and rear plates are similarly subdivided in a tandem timer unit assembly). A thin spring housing or barrel 55 is mounted against the back plate 52 and contains the main coil spring mounted to a shaft 56 projecting through the front plate 51 of the timer unit. The clock gear train 50 includes a main gear 57, sometimes referred to in the clockwork art as the first wheel, coupled by the interengaging gear teeth on the successive gears through a gear train including small pinion 58 fixed on shaft 59 having a large gear or second wheel 60 thereon coupled to a small pinion 61 on shaft 62 which also carries a large gear or third wheel 63. The teeth of the third wheel or gear 63 engage the small pinion 64 on shaft 65 having a large gear or fourth wheel 66 thereon. The fourth wheel 66 is meshed with the small pinion 67 on shaft 68 having the large gear 69 thereon, meshed with the small pinion 70 on the escapement wheel shaft 71. The escapement wheel or mechanism also includes a balance wheel in accordance with conventional practice.

Located just forwardly of the front plate 52 of the forwardmost timer unit is an intercoupling gear train including an input wheel or gear 75 which carries a linking pawl 76 which can engage via the linking pin 77 the input package 78 which is pivoted on shaft 79 fixed on front plate 51 coaxial with the extended axis of the combination lock dial spindle 27. The input package 78 is driven by the rearwardly projecting drive pin 32*c* extending from the drive cam 32, and contains a mechanism associated with hook lever 78*a* to easily align and linkup with the drive pin 32*c* of the combination lock and also contains a mechanism enabling it to detect whether one of the timing mechanisms is jammed if two timing mechanisms are provided in tandem. It also contains a linking pin 77.

Means, later described, are provided to unlock the linking pawl 76 at a precise position of the input wheel or gear 75. The input wheel 75 has number graduations just inwardly of its periphery at appropriate locations for time settings between four and 30 minutes. An optional stud, indicated in broken lines by reference character 75*s* in FIG. 4, may be provided to prevent time settings smaller than 15 minutes if desired. The input gear or wheel 75 is linked to the main drive shaft 56 of the time mechanism by an idler gear or intermediate wheel 80 engaging the gear 81 fixed to the main shaft 56 immediately forwardly of the front plate 51.

On the main shaft 56, an interact lever 82 is provided to block a cam lever 83 and release it after the set time has elapsed. This cam lever 83 is pivoted on a rugged post 88, which also carries a blocking lever 87 interacting with the upper rearwardly projecting pin 46 fixed to the adapter plate member 45 on the fence lever. Means are also provided to bias the bolt blocking lever 87 as soon as the bolt 40 is retracted, so that upon reclosure of the bolt, the bolt blocking lever 87 snaps back into blocking position, blocking the bolt and combination lock components against reopening even if the three to 4 minute opening time has not fully elapsed.

The time delay for the timer unit is initially set, when the movement is at a standstill, by partially unscrewing the shaft 79 of the input wheel 75 to bring the input wheel 75 out of mesh with the intermediate or idler gear 80. By turning the wheel 75, the markings on the wheel 75, indicating for example the time delay in increments of 5 minutes (each gear tooth representing an interval of 1 minute), can be aligned with a marking on idler gear 80 and the screw shaft 79 is turned in again, taking care that the teeth of wheels 75 and 79 mesh. The mechanism is now set for the time delay shown by the markings on the input gear 75. If the range limiting stud 75*s* is in place, the time settings are limited to a range from 15 to 30 minutes.

In operation, turning the combination lock dial 25 counterclockwise has no effect on the timer as the input package 78 and the input wheel 75 are not linked when the dial is rotated in the counterclockwise direction. Turning the combination lock dial 25 clockwise, however, will lead to linking of the linking pin 77 fixed on the input package 78 to the linking pawl on the input wheel or gear 75. The linking pin 77 on the input package 78 intercepts the linking pawl 76 carried on the input wheel or gear 75. The linking pawl 76 is biased inwardly by a biasing lever 76*a* which is also pivoted on the input wheel 75 and is itself biased inwardly by a spring 76*b*. When the linking pin 77 is positioned away from the linking pawl 76, then the biasing lever 76*a* which is always under spring pressure pushes the linking pawl 76 inwardly, so that it is in a position to intercept the linking pin 77. Turning of the input package counterclockwise causes the linking pin 77 at each passage to push the linking pawl 76 and biasing lever 76*a* out of its way and thus not developing any linkage between these elements. After the passing of the linking pin 77, the linking pawl 76 and biasing lever 76*a* fall back into intercepting position.

Turning of the input package clockwise causes the linking pin 77 to be intercepted by the linking pawl 76, which does not move away and a positive link is formed between the input package 78 and the input wheel 75. Turning of the input package 78 further in a clockwise direction causes the input package 78 to move the input wheel 75 through the interlinking of the pin 77 with the linking pawl 76, transmitting the necessary torque to the gear train and the spring barrels to wind up the spring barrel, or pair of spring barrels. This results in a pressure between the linking pin 77 and linking pawl 76. The resulting friction increases the force necessary to pull the linking pawl 76 out of engagement with the linking pin 77. This means that once torque is transmitted, biasing lever 76*a* is no longer necessary to hold the linking pawl 76 engaged with the linking pin 77. Therefore the positive link between the input package 78 and the input wheel 75 is not broken when the biasing lever 76*a* is actively pushed away from contact with the linking pawl 76. This happens at some degrees of rotation of the linked system prior to reaching the desired end position which defines zero time.

The retraction of the biasing lever 76*a* is initiated by the lever 76*a* pushing against pin 85 located on the front plate 51 and by the shape of the lever 76*a* which comes into sliding contact with the pin 85. Because of the positive link between the linking pawl 76 and linking pin 77, described above, the linking pawl 76 remains firmly engaged with the linking pin 77 and the link between the input package 78 and input wheel 75 is held. A few degrees later, a finger-shaped part of the linking pawl 76 comes into contact with the same pin 85 on the front plate 51, which now actively pushes the pawl 76 against the strong friction force between it and the linking pin 77 out of engagement with the linking pin 77, breaking the link between the input package 78 and input wheel 75 in a snap-action fashion. The angle of rotation when this occurs is defined as the zero time angle because once the link is broken, the mechanism starts ticking off time. The biasing lever 76*a*, in this position and all the angular positions for the following 1–2 minutes, is held out of contact with the linking pawl 76 resting on the pin 85, so that the linking pawl 76 remains in the open position. This is important because the input package 78 with its linking pin 77 passes by the linking pawl 76 several times clockwise and counterclockwise when the operator dials the final dialing code or dial combination. As the timing movement runs from zero time onward, it slowly turns back the associated gear train and with it the input wheel 75, linking pawl 76 and biasing lever 76*a*. Biasing lever 76*a* therefore slides back on the pin 85, gradually coming closer to the linking pawl 76, contacting it and from thence onward pushing linking pawl 76 back towards the intercepting position with linking pin 77. Approximately 2 minutes after zero time, linking pawl 76 is again in a position where it could intercept the linking pin 77 if the input package 78 is continued to be turned. This would result in a new windup of the mechanism and a new definition of zero time. It is understood in normal handling, 2 minutes are more than sufficient to finish dialing of the combination, so that at the time when linking pawl 76 could intercept again, there is no longer any movement on the input package 78.

As the spring barrel or barrels 55 resist(s) winding according to its (their) winding torque, enough torque must be applied to the combination lock dial 25 to accomplish the winding action. This same torque passes through the input package 78. A fork-shaped arm 78*b* will swing out of the input package 78 at the beginning of movement when torque builds up, and swings back again into its rest position when full torque is applied. Releasing the input dial 25 makes the fork 78*b* swing out and in again in rapid movement. The design is made so that the fork 78*b* will be in for negligible or very small torques and for torques equalling the combined torques of two spring barrels, but stay out for input torques equal to the torque of one spring barrel. In the in position of the fork 78*b*, shown in FIGS. 4 and 9, the fork does not find any obstacle while turning about the shaft 79 together with the movement of the dial 25 and the input package 78. On the other hand, the fork 78*b* hits a strong post 84 riveted firmly on the front plate 51 when it is in the out position and is therefore stopped by this post 84, blocking all movement of the whole input system, lock dial 25, input package 78, and wheel 75.

With two timing mechanisms present, if both timing mechanisms work correctly, both spring barrels 55 time down and have to be wound up again on the subsequent working cycle. The whole torque of the two spring barrels 55 has to be applied keeping the fork 78*b* in and thus preventing it from being stopped. The operator can wind up the mechanism without being hindered. On the other hand, if one of the timing mechanisms jams during one operation, it does not time down and therefore does not have to be wound up on the subsequent working cycle. The demanded input torque corresponds therefore only to one spring barrel torque leaving the fork 78*b* out. While turning, the fork 78*b* hits and locks on the stopping post 84, giving a definitive stop to the movement of the dial 25 which cannot be ignored. By turning back the dial 25 after such stopping has occurred by a small or large amount, the fork 78*b* unlocks from the stopping post 84 and falls back into the in position. If afterwards within the next 1 or 2 minutes, the dial 25 is again turned clockwise, the rest of the movement required for full winding can be accomplished, so that proper operation of the time delayed lock is assured even after one mechanism has either jammed or the corresponding main spring broken. The damaged timing mechanism does not at all impair proper functioning, and the only difference observed from outside of the lock is that winding up has to be done in two strokes.

At the end of the winding up angle of the input wheel 75, driven by the input package 78 through the linking pawl 76, a spring biased lever 76*a* of the linking pawl 76 abuts against a pin 85 located on the front plate 51. This pin 85 pulls the linking pawl 76 slowly out of engagement with the input package 78 and at a very precise position of the input wheel 75 relative to the front plate 51, the linking pawl 76 opens and the link with the input package is broken. From this time on, the spring barrel or barrels 55 exert torque forward on to the associated escapement(s) through the intervening gear train(s). The spring biased lever 76*a* is also held back by the stopping pin 85 on the front plate 51. This together with the special design of the linking pawl 76 and its piviot keep the linking pawl in the open position for the following 1 to 2 minutes.

Assuming, for example, that the time has been set to 10 minutes and the time scale starts at the moment when the linking pawl 76 opens, which may be called zero minutes. In the interval from zero to approximately 1.5 minutes, the combination lock dial 25 can be turned freely clockwise or counterclockwise for setting up the proper combination, without influencing at all the timer mechanism which has started ticking off time from zero time onwards. As time increases, the spring barrel or barrels 55 unwind turning the shaft 56 counterclockwise, the idler gear 80 clockwise, and the input gear or wheel 75 counterclockwise. The spring biased lever 76*a* of the linking pawl 76 moves away from the stopping post 84. The spring biased lever 76*a* also moves away pushing the linking pawl 76 again into a position where it might lock with the input package 78. By then the combination has been dialed, the bolt lever 41 of the combination lock is engaged, but the bolt 40 cannot be retracted because the blocking lever 87 located in the bolt opening path of the stud 46 on the fence lever adapter plate 45 stops it. Great forces applied to the blocking lever 87 are taken up by the shoulder 48*b* in the top wall 48*c* of the rear case section 48, and therefore the forces on the blocking lever do not have to be absorbed by the timer unit which only guides the blocking lever 87.

The blocking lever 87 pivots about post 88 and is biased by spring 89. The pivot hole of the blocking lever is not round, but elongated and the axis of the elongation is in direction coinciding with the direction of the thrust force originating from pin 46 going to abutment shoulder 48*b* in the case. As a matter of fact, the force line from pin 46 to shoulder 48*b* passes exactly through the center of the elongated hole. Biasing spring 89 has a pivoting effect on lever 87, but in addition also has a lateral shifting effect on lever 87 along the line from 48*b* to 46, towards 46, thus keeping lever 87 abutting against stop 88 with that end of the elongated hoe which is on the side of shoulder 48*b*, thus keeping lever 87 well clear of shoulder 48*b*, so that there is no stalling friction induced between lever 87 and the case as long as pin 46 does not push against lever 87. As soon as torque is applied to the input dial while lever 87 is still in blocking position, pin 46 abuts against lever 87 pushing it towards shoulder 48*b* against the spring load of spring 89. Because of the elongated hole and the fact that the force line goes through the center of this hole, no reaction of this thrust force is felt by the timer; blocking lever 87 can be regarded as a single interlinking rod between pin 46 and the case.

The blocking lever 87 is dynamically balanced so shocks from the outside will not turn it out of its blocking position, and is mounted on the post 88 which also provides the pivot post for the cam lever 83, and is biased by spring 89 holding it in the blocking position. The cam lever 83 is held in the blocking position by the interact lever 82 pivoted on the shaft 56. The interact lever 82 is held in its rest position by a biasing spring 90 and is dynamically balanced so that shocks will not be able to swing it out of its rest position. This whole combination keeps the bolt locked securely during the set time delay.

As the time ticks off, the shaft 56, idler gear 80 and input wheel 75 turn correspondingly. The shaft 56 carries the gear or wheel 81 in front of the front plate 51 having a pin 81*a* projecting therefrom. As time equals approximately 9.3 minutes (in the 10 minute delay example), the pin 81*a* abuts against a pin 82*a* located on the interact lever 82, and from this time on, the interact lever 82 turns together with the shaft 56. When the set time has elapsed, such as 10 minutes in the described example, the interact lever 82 with its roller 82*b* frees cam lever 83 which under the influence of its biasing spring 89 swings clockwise, swinging upwardly its pin 83*a* projecting into a hole 87*a* in lever 87 and taking the blocking lever 87 with it. This also frees the bolt 40 which can now be retracted.

The other pin 47 on the fence lever adapter plate 45 intercepts the interact lever 82 when the bolt is retracted, pushing the interact lever 82 to one end position. Before the interact lever 82 reaches this position, it pushes the cam lever 83 back to its locking position by means of an inclined plane or ramp surface leading to crest 83*b* on the cam lever 83. At the end of the movement of the interact lever 82, it is pushed over the crest 83*b* in the cam surface of the cam lever 83, whereupon it remains safely locked in this position even after the adapter plate pin or stud 47 is no longer in contact with the interact lever 82. The blocking lever 87 cannot follow the corresponding movement of the cam lever 83, but it is biased toward the blocking position by its spring 89. Thus, immediately upon reclosing of the bolt, the blocking lever 87 snaps-back into the blocking position, assuring an immediate reblocking of the lock once the lock has been opened and reclosed even if the opening time has not fully elapsed.

If on the other hand, the blocking lever 87 has freed the bolt for release, but no action is taken to open the lock, the interact lever 82 remains in its position determined by the angular position of the shaft 56. The cam shape on the cam lever 83 includes a recess 83*c* so designed that for the next approximately 3.5 minutes, the cam lever 83 takes up a position determined by the interact lever roller 82*b* enabling the bolt to be opened. After this opening time of approximately 3.5 minutes has elapsed, the roller 82*b* on the interact lever 82 has pushed the cam lever 83 sufficiently back so that the blocking lever 87 which follows the cam lever 83 again blocks the bolt 40 against opening movement. After the blocking lever 87 has again blocked the bolt 40, the interact lever 82 continues to move the cam lever 83 back. Approximately 1.5 minutes later, the roller 82*b* of the interact lever 82 is pushed over the crest 83*b* of the cam lever 83. About 2.2 minutes after reblocking has occurred, the whole mechanism comes to rest. In this rest position, the spring barrel or barrels 55 with all their torque hold the interact lever 82 in such a position that it deadbolts the cam lever 83, and therefore the blocking lever 87, and therefore blocks the bolt against retraction from its locking position.

To review the action briefly, sometime after the mechanism has come to a standstill and remains in its rest position, a new working cycle is started. The lock dial 25 is turned which, through the input package 78, turns the input wheel 75 and idler gear 80 and the shaft 56. The pin 81*a* on the gear 81 on shaft 56 moves back from the pin 82*a* on the interact lever 82. The biasing spring 90 for the interact lever 82 tends to push this lever back, but the crest 83*b* on the cam shape surface of the cam lever 83 prevents the interact lever 82 from moving. During this phase, the components stay in a position wherein the interact lever 82 and cam lever 83 mutually lock each other and via the blocking lever 87 lock the bolt 40. Thus, during all the winding phase, the lock remains deadbolted. At the very end of the movement of the input wheel 75 towards its predetermined position where the linking pawl 76 breaks the link between the input package 78 and the timer (which corresponds to time equals zero for the sequence of timer operation and also corresponds to fully wound up spring barrels), the pin 75*a* on the input wheel 75 abuts against a projection 83*d* on the cam lever 83. The result is that the cam lever 83 slightly turns in the counterclockwise direction releasing the interlock between the crest 83*b* of the cam lever 83 and the interact lever 82, enabling the interact lever 82 to swing under the influence of its biasing spring to its rest position. During all this time, the blocking lever 87 has remained in its locking position. During the next 2 minutes forming the first 2 minutes of the working cycle, the pin 75*a* on the input gear 75 slowly moves back from the end 83*d* of the cam lever 83, freeing the cam lever 83 which is then held in locking position by the roller 82*b* of the interact lever 82 seated in the notch 83*e* during the following minutes until the approximate set time has elapsed. Then the roller 82*a* of the interact lever 82 is moved into recess 83*c* of the cam lever 83 by interengagement of pins 81*a* and 82*a* moving the lever 82. This allows the lever 83 to assume a position which shifts blocking lever 87 to upward unblocking position for the about 3.5 minutes allowed for retracting the bolt. The interact lever 82 then returns to the left hand end position shown in FIG. 4, as previously described, either by retracting the bolt or timing out of the timing mechanism.

It will be noted that the arrangement of the components in the one or two timer units is such that an access hole 95 which lines up with a combination change key hole 95*a* in the rear wall 48*a* of the timer case section is in alignment with the combination change cam, such as indicated at 35*b* in FIG. 3, in each of the tumbler wheels 35,36 and 37 when the tumbler wheels are properly oriented to the combination change position. Therefore, with this construction, the combination change key can be inserted from the back to change the combination of the tumbler wheels when the timing mechanism has been wound up by dialing the old combination. This is because the protrusion 75*c* on the periphery of the input wheel or gear 75 is in the wound up position shown in FIG. 5 not in intercepting relation in the path of the combination change key between the opening provided therefor in the intermediate plate 52 (the backplate of the forwardmost timer unit) and the registering space 51*b* in the other timer unit plate or plates, except when the input wheel 75 has been displaced fully to its set time delay position by the winding up of the timer unit during dialing of the old combination.

Also, it should be noted that the various elements built on or about the shaft 56 are all assembled on the back plate 52 (or intermediate plate in the tandem pair timer units) and the part of the other plate 51 other than that which carries the escapement and balance mechanism, the latter being assembled to the back plate 52, so that the whole unit may be assembled onto the rear wall 48*a* of the rear case section 48 by three recessed screws from the back of the case section 48. This with its assembled timer mechanism may then be assembled onto the front combination lock section 20 and the mounting door by two additional recessed screws. This design enables one to disassemble all of the elements built on or about the shaft 56 without any other tool than a screwdriver.

The input package 78, previously referred to, which is used when two timing mechanisms are present, as previously described, is formed, in the preferred embodiment illustrated in FIGS. 7 and 9, of a front plate 78*c* and a rear plate 78*d* assembled together as a pair of plates by a bushing 78*e* extending rearwardly from the front plate 78*c* and fixed thereto, which is rotatably channeled in and projects rearwardly through a cylindrical sleeve 78*f* fixed to the rear plate 78*d*. A suitable lock ring 78*g* is fitted on the rearwardmost end of the shaft 79 projecting through the bushing 78*e* immediately forwardly of the front face of front plate 78*c* to retain the package 78 on the shaft 79. A torsion spring 78*h* is wound about the sleeve 78*f* and terminates in two radially projecting ends, the shorter end bearing against a fixed post 78*i* and the longer end of the torsion spring bearing against the post 78*j* and extending beyond the perimeter of the front plate 78*c*. As will be seen, the two ends of the torsion spring 78*h* are captured between the posts 78*i* and 78*j*, so that the portion of the longer spring end projecting beyond the perimeter of the front plate is in the path of movement of the pin 78*k* to be engaged by that pin when the front plate 78*c* has been rotated through a predetermined short initial arc relative to the rear plate 78*d*, so that further relative rotation of the front plate 78*c* is resiliently resisted by the spring force of the torsion spring 78*h*.

The pivoted fork arm 78*b*, previously discussed, is pivoted at its end opposite its fork-shaped end on a pivot post 78*m* and is biased radially inwardly by its spring 78*n*, while the hook lever 78*a* is pivoted intermediate its ends on the pivot post 78*p* and is biased inwardly by an arm of spring 78*n* bearing against a post projecting from the hook lever 78*a*. The pivot post 78*m* fixed to the rear plate 78*d* extends into an arcuate slot 78*q* of the front plate, determining the limits of relative movement of the rear plate 78*d* and the levers 78*a* and 78*b* carried thereon relative to the rear plate 78*d*.

Figure 4:
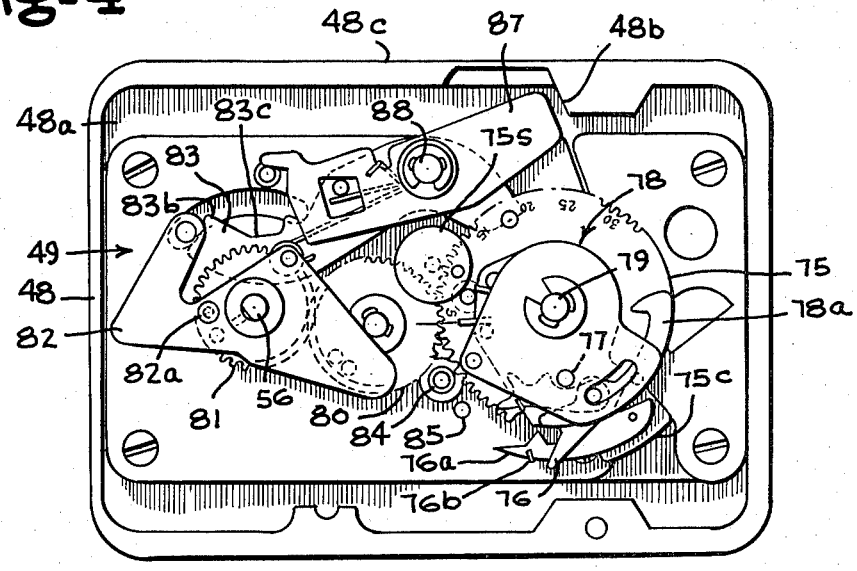
FIG. 4 is a front elevation view of the time delay section removed from the combination lock section.
Figure 5:
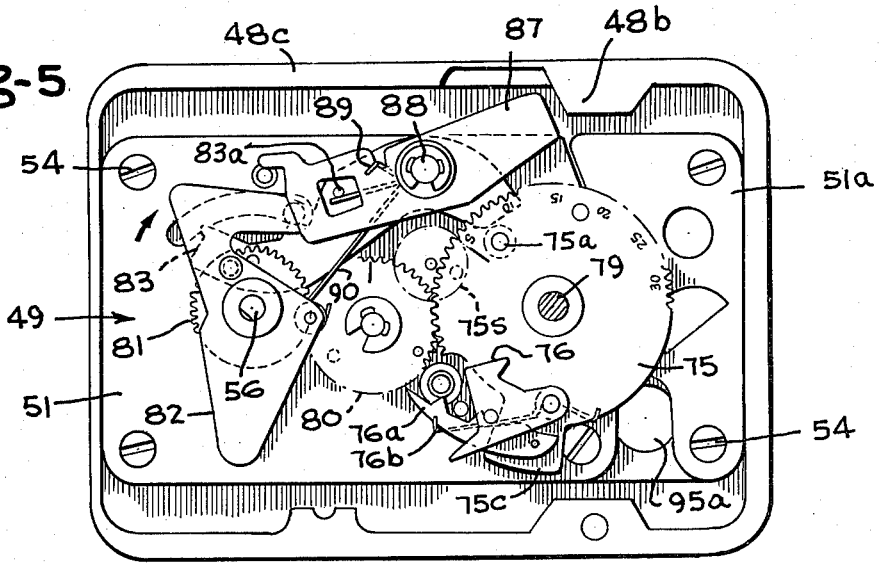
FIG. 5 is a view similar to FIG. 4 with the plates and associated levers of the input package removed and the time delay section in fully wound up condition.
Figure 6:
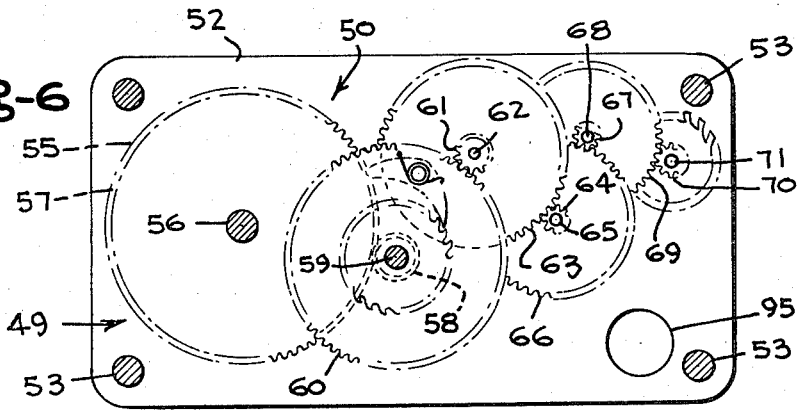
FIG. 6 is a vertical section view of the time movement gear train and escapement.

As will be seen from FIGS. 4, 7 and 9, the front plate 78*c* has a shoulder 78*r* positioned to be disposed in the path of the drive pin 32*d* projecting rearwardly from the drive pin 32 to be engaged by the pin 32*d* upon counterclockwise rotation of the dial and spindle and transmit counterclockwise rotation to the input package. As previously described, the linking pin 77 projecting rearwardly from the rear plate 78*d* of the input package is brought into linking engagement with the linking pawl 76 on the input wheel 55 and rotates the input wheel 55, in normal operation with the tandem pair of timing units, against the torque of the two spring barrels to wind up the mechanism and start the timing cycle. When the demanded input torque corresponds only to one spring barrel torque, as when one of the timing mechanisms has jammed during one of the previous functions, the fork lever 78*b* of the input package is moved outwardly by the pin 78*s* projecting rearwardly from the front plate 78*c* upon relative rotation of the front plate 78*c* with respect to rear plate 78*d*, and the co-rotation of the two plates of the input package causes the fork lever 78*b* to hit and lock on the stopping post 84, informing the operator that one of the timing mechanisms is jammed. By turning back the dial 25 by a small or large amount, the fork 78*b* unlocks from the stopping post 84 and falls back into the in position, after which the dial can again be turned clockwise through the rest of the movement required for full winding.

When two main springs have to be wound up, the full torque corresponding to these two main springs passes through the input package. Turning the input dial clockwise moves the input package 78 until pawl 76 links with pin 77 and torque is built up. From this moment on the fact that input package 78 is not a solid block but formed essentially by two discs 78*c* and 78*d* which are only linked together rotationally through spring 78*h* enables relative movement of rotation between the input and the output side of package 78 compressing more or less spring 78*h* corresponding to the transmitted torque. What in detail happens is the following: The first few degrees of a relative motion needs very little torque as pin 78*k* does not yet contact spring 78*h* and only the small effect of spring 78*h* through lever 78*b* has to be overcome. This first movement brings fork 78*b* out and keeps it out. This is the case for input torques corresponding to one spring barrel. If two spring barrels resist, then the output disc does not yet turn even turning the input further. Pin 78*k* contacts spring 78*h* and compresses it until the spring end against pin 78*j* contacts the end against pin 78*i*, thus making a firm link between input and output of package 78, so that the full necessary torque can be transmitted. This additional relative movement between input and output sides has moved the fork lever operating pin 78*s* away from the crest of the cam of fork lever 78*b*, so that 78*b* can snap back again to its rest position under the influence of its spring 78*n*. The reverse happens when torque applied to the input dial diminishes from full torque (2 barrels) to zero torque, the fork 78*b* moves out and then in again.

If only a single timing mechanism 50 is employed, then the components of the input package 78 other than the front plate 78*c*, and hooking lever 78*a* with biasing spring 78*n* are dispensed with, and the plate 78*c* is simply journaled on the shaft 79 of the input wheel 75 and is provided with the rearwardly projecting linking pin, which will be somewhat longer than the linking pin 77 used with the dual plate input package. The plate 78*c* employed with the single timing mechanism has the same configuration, including the shoulder formation 78*r*, as the front plate of the previously described package, except that a rearwardly projecting linking pin is fixed to the plate 78*c* at the location which was occupied by the fork lever operating pin 78*s* and the dual plate input package configuration. The operation of the timed delay wheel and lever components in the single timing mechanism embodiment is otherwise like that of the previously described two timing mechanism embodiments.

We claim:

1. In a time delay combination lock including a lock case, a combination mechanism including a plurality of peripherally gated tumbler wheels rotatably journaled about a common axis, a driving cam on a drive spindle extending along said axis from a dial to adjust the angular positions of the tumbler wheels through lost motion couplings, and a fence lever pivoted on a reciprocative bolt to descend from a raised position to a lower coupled position with the drive cam and movable thereby along an unlocking path at the lower coupled position to retract the bolt; a timer mechanism in the lock case having a clockwork mechanism including a main spring and a main shaft, an intercoupling gear train for transmitting drive to and from the main shaft including an input gear adjacent said driving cam, means on said driving cam for activating the input gear to wind the main spring to wound-up condition upon rotation of the dial and driving cam through a predetermined arc, a pivoted blocking lever biased to a normal blocking position disposing an abutment shoulder adjacent and in the unlocking path of a portion of the fence lever to bar unlocking movement of the fence lever in its lower coupled position, said lock case having a fixed backup shoulder immediately adjacent said blocking lever in a direction to engage and support the blocking lever against attempted forced displacement of the fence lever and bolt in a bolt unlocking direction, the intercoupling gear train including means for permitting multidirectional operation of the dial to dial the unlocking combination for a limited-time dialing period during a first time interval following wind-up of the main spring, and lever means coactive with said intercoupling gear train to displace said blocking lever to a release position out of the unlocking path of said fence lever portion for a limited release time period commencing a predetermined several minute time delay interval after termination of the multidirectional dialing period to allow retraction of the bolt to unlocked condition.

2. A time delay combination lock as defined in claim 1, wherein said fence lever includes a rearwardly projecting stop post thereon, said input gear being disposed rearwardly adjacent said driving cam concentric with the axis thereof, and said abutment shoulder being an end of said blocking lever immediately adjacent and in the path of said stop post along the unlocking path of said fence lever.

3. A time delay combination lock as defined in claim 1, wherein abutment shoulder is one end of said blocking lever located adjacent and in the path of a protrusion on said fence lever along the unlocking path thereof and the blocking lever having an opposite end located immediately adjacent and confronting said fixed backup shoulder.

4. A time delay combination lock as defined in claim 1, wherein abutment shoulder is one end of said blocking lever located adjacent and in the path of a protrusion on said fence lever along the unlocking path thereof and the blocking lever having an opposite end located immediately adjacent and confronting said fixed backup shoulder, said blocking lever being pivotally supported at an intermediate portion between its ends causing its said one end to rise out of intercepting position about said unlocking path during time delay interval.

5. A time delay combination lock as defined in claim 1, wherein abutment shoulder is one end of said blocking lever located adjacent and in the path of a protrusion on said fence lever along the unlocking path thereof and the blocking lever having an opposite end located immediately adjacent and confronting said fixed backup shoulder, said blocking lever being pivotally supported at an intermediate portion between its ends causing its said one end to rise out of intercepting position about said unlocking path during time delay interval and concurrently displacing said opposite end out of confronting relation below said backup shoulder.

6. A time delay combination lock as defined in claim 1, wherein said lock case includes a rear case portion for the timer mechanism having cast rigid integral interconnected top, bottom and end walls, said top wall having an integral downwardly extending boss formation having an inclined ramp surface forming a side of said backup shoulder closely adjacent and substantially paralleling an end portion of said blocking lever.

7. A time delay combination lock as defined in claim 3, wherein said lock case includes a rear case portion for the timer mechanism having cast rigid integral interconnected top, bottom and end walls, said top wall having an integral downwardly extending boss formation having an inclined ramp surface forming a side of said backup shoulder closely adjacent and substantially paralleling said opposite end of said blocking lever.

8. A time delay combination lock as defined in claim 4, wherein said lock case includes a rear case portion for the timer mechanism having cast rigid integral interconnected top, bottom and end walls, said top wall having an integral downwardly extending boss formation having an inclined ramp surface forming a side of said backup shoulder closely adjacent and substantially paralleling said opposite end of said blocking lever.

9. A time delay combination lock as defined in claim 1, including a coupler mechanism journaled for rotation forwardly adjacent said input gear including means for releasible connection with a protrusion on the driving cam to be rotated thereby and transfer unidirectional rotation to said input gear in wind-up direction only, and said input gear including a linking pawl thereon and associated biasing lever coactive with a linking pin extending from said coupler mechanism to interlink the linking pin and linking pawl for said unidirectional rotation and terminating such interlinking at a precise angular position of said input gear.

10. A time delay combination lock as defined in claim 3, including a coupler mechanism journaled for rotation forwardly adjacent said input gear including means for releasible connection with a protrusion on the driving cam to be rotated thereby and transfer unidirectional rotation to said input gear in wind-up direction only, and said input gear including a linking pawl thereon and associated biasing lever coactive with a linking pin extending from said coupler mechanism to interlink the linking pin and linking pawl for said unidirectional rotation and terminating such interlinking at a precise angular position of said input gear.

11. A time delay combination lock as defined in claim 5, including a coupler mechanism journaled for rotation forwardly adjacent said input gear including means for releasible connection with a protrusion on the driving cam to be rotated thereby and transfer unidirectional rotation to said input gear in wind-up direction only, and said input gear including a linking pawl thereon and associated biasing lever coactive with a linking pin extending from said coupler mechanism to interlink the linking pin and linking pawl for said unidirectional rotation and terminating such interlinking at a precise angular position of said input gear.

12. A time delay combination lock as defined in claim 6, including a coupler mechanism journaled for rotation forwardly adjacent said input gear including means for releasible connection with a protrusion on the driving cam to be rotated thereby and transfer unidirectional rotation to said input gear in wind-up direction only, and said input gear including a linking pawl thereon and associated biasing lever coactive with a linking pin extending from said coupler mechanism to interlink the linking pin and linking pawl for said unidirectional rotation and terminating such interlinking at a precise angular position of said input gear.

13. A time delay combination lock as defined in claim 1, wherein said timer mechanism comprises two clockwork mechanisms and associated main springs mounted in a tandem array and having a single common main shaft connected to said intercoupling gear train, a coupler mechanism journaled for rotation forwardly adjacent said input gear including means for releasible connection with a protrusion on the driving cam to be rotated thereby and transfer unidirectional rotation to said input gear in wind-up direction only, said input gear including a linking pawl thereon and associated biasing lever coactive with a linking pin extending from said coupler mechanism to interlink the linking pin and linking pawl for said unidirectional rotation and terminating such interlinking at a precise angular position of said input gear, and said coupler mechanism including a spring and stop lever means having a predetermined relation to the resistance torque of the two main springs to displace the stop lever to a releasible stop-abutting position at predetermined lower resistance torque levels to indicate by stop abutment that one clockwork mechanism is abnormal.

14. A time delay combination lock as defined in claim 3, wherein said timer mechanism comprises two clockwork mechanisms and associated main springs mounted in a tandem array and having a single common main shaft connected to said intercoupling gear train, a coupler mechanism journaled for rotation forwardly adjacent said input gear including means for releasible connection with a protrusion on the driving cam to be rotated thereby and transfer unidirectional rotation to said input gear in wind-up direction only, said input gear including a linking pawl thereon and associated biasing lever coactive with a linking pin extending from said coupler mechanism to interlink the linking pin and linking pawl for said unidirectional rotation and terminating such interlinking at a precise angular position of said input gear, and said coupler mechanism including a spring and stop lever means having a predetermined relation to the resistance torque of the two main springs to displace the stop lever to a releasible stop-abutting position at predetermined lower resistance torque levels to indicate by stop abutment that one clockwork mechanism is abnormal.

15. A time delay combination lock as defined in claim 5, wherein said timer mechanism comprises two clockwork mechanisms and associated main springs mounted in a tandem array and having a single common main shaft connected to said intercoupling gear train, a coupler mechanism journaled for rotation forwardly adjacent said input gear including means for releasible connection with a protrusion on the driving cam to be rotated thereby and transfer unidirectional rotation to said input gear in wind-up direction only, said input gear including a linking pawl thereon and associated biasing lever coactive with a linking pin extending from said coupler mechanism to interlink the linking pin and linking pawl for said unidirectional rotation and terminating such interlinking at a precise angular position of said input gear, and said coupler mechanism including a spring and stop lever means having a predetermined relation to the resistance torque of the two main springs to displace the stop lever to a releasible stop-abutting position at predetermined lower resistance torque levels to indicate by stop abutment that one clockwork mechanism is abnormal.

16. A time delay combination lock as defined in claim 6, wherein said timer mechanism comprises two clockwork mechanisms and associated main springs mounted in a tandem array and having a single common main shaft connected to said intercoupling gear train, a coupler mechanism journaled for rotation forwardly adjacent said input gear including means for releasible connection with a protrusion on the driving cam to be rotated thereby and transfer unidirectional rotation to said input gear in wind-up direction only, said input gear including a linking pawl thereon and associated biasing lever coactive with a linking pin extending from said coupler mechanism to interlink the linking pin and linking pawl for said unidirectional rotation and terminating such interlinking at a precise angular position of said input gear, and said coupler mechanism including a spring and stop lever means having a predetermined relation to the resistance torque of the two main springs to displace the stop lever to a releasible stop-abutting position at predetermined lower resistance torque levels to indicate by stop abutment that one clockwork mechanism is abnormal.

17. A time delay combination lock as defined in claim 8, wherein said timer mechanism comprises two clockwork mechanisms and associated main springs mounted in a tandem array and having a single common main shaft connected to said intercoupling gear train, a coupler mechanism journaled for rotation forwardly adjacent said input gear including means for releasible connection with a protrusion on the driving cam to be rotated thereby and transfer unidirectional rotation to said input gear in wind-up direction only, said input gear including a linking pawl thereon and associated biasing lever coactive with a linking pin extending from said coupler mechanism to interlink the linking pin and linking pawl for said unidirectional rotation and terminating such interlinking at a precise angular position of said input gear, and said coupler mechanism including a spring and stop lever means having a predetermined relation to the resistance torque of the two main springs to displace the stop lever to a releasible stop-abutting position at predetermined lower resistance torque levels to indicate by stop abutment that one clockwork mechanism is abnormal.

18. A time delay combination lock as defined in claim 1, wherein said timer mechanism comprises two clockwork mechanisms and associated main springs mounted in a tandem array and having a single common main shaft connected to said intercoupling gear train, a coupler mechanism journaled for rotation forwardly adjacent said input gear including means for releasible connection with a protrusion on the driving cam to be rotated thereby and transfer unidirectional rotation to said input gear in wind-up direction only, and said coupler mechanism including a spring and stop lever means having a predetermined relation to the resistance torque of the two main springs to displace the stop lever to a releasible stop-abutting position at predetermined lower resistance torque levels to indicate by stop abutment that one clockwork mechanism is abnormal.

19. A time delay combination lock as defined in claim 2, wherein said timer mechanism comprises two clockwork mechanisms and associated main springs mounted in a tandem array and having a single common main shaft connected to said intercoupling gear train, a coupler mechanism journaled for rotation forwardly adjacent said input gear including means for releasible connection with a protrusion on the driving cam to be rotated thereby and transfer unidirectional rotation to said input gear in wind-up direction only, and said coupler mechanism including a spring and stop lever means having a predetermined relation to the resistance torque of the two main springs to displace the stop lever to a releasible stop-abutting position at predetermined lower resistance torque levels to indicate by stop abutment that one clockwork mechanism is abnormal.

20. A time delay combination lock as defined in any of claims, 1, 3, 5, 6, 9, 13 or 18, wherein said lever means includes a cam lever for positioning the blocking lever and an interact lever coactive with the cam lever to locate the latter at first and second positions disposing the blocking lever at said blocking and release positions respectively, said interact lever having a part in the retraction path of a projection on the fence lever to be engaged by said projection whenever the fence lever and bolt are retracted to unblocking position and return said blocking lever immediately to said blocking position upon bolt retraction at any time during said release time period.

21. A time delay combination lock as defined in any of claims 1, 3, 5, 6, 9, 13 or 18, wherein said lock case includes a rear wall having a change key opening therein alined along a key path with combination change cams in said tumbler wheels when a predetermined lock combination has been dialed said input gear having a change key barrier formation carried thereby extending from a peripheral portion thereof of predetermined circumferential extent protruding in key-intercepting relation into said key path over a range of angular positions of said input gear at and near unwound condition of the timer mechanism and spaced out of such key-intercepting relation at selected input gear positions, the remaining parts of the timer mechanism being positioned out of intercepting relation with said key path for accommodating insertion of the change key from the rear of the lock case at predetermined change condition of the lock.

22. A time delay combination lock as defined in any claims 1 or 3 or 5 or 9 including means coactive with said lever means and blocking lever for immediately returning said blocking lever from its release position to its blocking position responsive to movement of the bolt to retracted position at any time during said time release period prior to the end of said time release period.

* * * * *